US005964380A

United States Patent [19]

Hazzard et al.

[11] Patent Number: 5,964,380

[45] Date of Patent: Oct. 12, 1999

[54] VISCOUS LIQUID APPLICATOR

[75] Inventors: Ruth V. Hazzard, Amherst, Mass.; Ellen D. Siedlecki, Greensboro, N.C.; Brian B. Schultz, Amherst, Mass.; Douglas A. Hartwell, S. Burlington, Vt.

[73] Assignees: University of Massachussets, Boston; Trustees of Hampshire College, Amherst, both of Mass.

[21] Appl. No.: 08/908,368

[22] Filed: Aug. 7, 1997

[51] Int. Cl.[6] ..... B67D 5/40

[52] U.S. Cl. ..... 222/309; 222/323; 222/324; 222/383.3

[58] Field of Search ..... 222/309, 323, 222/324, 383.1

[56] References Cited

U.S. PATENT DOCUMENTS

| | | | |
|---|---|---|---|
| 3,701,478 | 10/1972 | Tada . | |
| 3,878,973 | 4/1975 | Riccio . | |
| 4,007,855 | 2/1977 | Hierath et al. . | |
| 4,077,494 | 3/1978 | Spaude et al. | 222/383.1 |
| 4,436,227 | 3/1984 | Johnson, Jr., et al. | 222/382 |
| 4,498,904 | 2/1985 | Turner et al. . | |
| 4,602,726 | 7/1986 | Goda . | |
| 4,664,298 | 5/1987 | Shew | 222/383.1 |
| 4,747,523 | 5/1988 | Dobbs . | |
| 4,896,832 | 1/1990 | Howlett . | |
| 5,031,839 | 7/1991 | Waldrum | 239/331 |
| 5,088,649 | 2/1992 | Hanson et al. . | |
| 5,551,603 | 9/1996 | Woodruff | 222/383.1 |
| 5,642,860 | 7/1997 | Bush et al. | 239/333 |
| 5,720,418 | 2/1998 | Timmerman et al. | 222/309 |

OTHER PUBLICATIONS

Carruth, "An Investigation of the Mineral Oil Treatment for Corn Earworm Control", *J. Economic Entomology,* 35(3):227–233 (1942).

E–Z Mini Dosers, Recoil, Inc. (1992).

Cole–Parmer Instrument Company (1992).

*Primary Examiner*—Andres Kashnikow
*Assistant Examiner*—Keats Quinalty
*Attorney, Agent, or Firm*—Fish &Richardson P.C.

[57] ABSTRACT

The invention features an applicator for delivering a defined, adjustable quantity of a viscous liquid, in a short stream. The applicator can be used, for example, to accurately and easily apply oil to ears of sweet corn to prevent infestation by corn earworms.

16 Claims, 2 Drawing Sheets

VISCOUS LIQUID APPLICATOR

BACKGROUND OF THE INVENTION

The invention relates to a device for delivering a stream of a defined, adjustable quantity of viscous liquid.

The corn earworm is a pest that plagues corn, e.g., sweet corn, crops throughout the United States. The larvae enters ears of corn through the silk channels at the neck of the ear and causes serious injury to the ear. Currently, corn earworms and other pests such as corn borers, fall armyworms, and other ear-invading caterpillars that infest sweet corn are controlled by repeated applications of insecticides that have broad toxicity to mammals, birds, and beneficial insects throughout the period of ear development, which lasts two to three weeks. In many areas, such use of insecticide is highly undesirable.

Recent emphasis on sustainable and organic farming practices among corn-growers has brought about an alternative method of controlling such pests, i.e., the use of oil, which is a natural product, to protect the corn. Oil applied directly to the silk acts as a barrier to prevent entry of the larvae of earworms into the corn ear, and also kills larvae already within the ear.

SUMMARY OF THE INVENTION

The invention features an applicator for delivering a defined, adjustable quantity of a viscous liquid, in a short stream. The applicator can be used to apply oils accurately and easily to ears of corn on corn stalks to protect against corn earworms.

In general, the invention features an applicator for delivering a stream of viscous liquid to a target. The applicator includes (1) a housing having a first longitudinal axis; (2) an inlet arranged at a proximal end of the housing; (3) an outlet arranged at a distal end of the housing at an angle of 75° to 105° relative to the first longitudinal axis of the housing; (4) a reservoir secured to the housing and comprising a cylinder, a fluid port at a distal end of the cylinder, and a plunger opening at a proximal end of the cylinder, the reservoir having a second longitudinal axis; (5) a plunger arranged to slide within the reservoir and comprising a piston connected to a shaft, the shaft having a third longitudinal axis, the plunger sliding within the reservoir between a filling position and a discharge position, wherein the piston forms a seal against the cylinder sufficient to prevent the viscous liquid from passing, wherein proximal displacement of the plunger towards the filling position draws the viscous liquid into the reservoir through the fluid port, and wherein distal displacement of the plunger towards the first discharge position displaces the viscous liquid out of the reservoir through the fluid port; (6) a handle pivotally connected to the housing and arranged in mechanical communication with the plunger, wherein the handle is movable between a charging position and a dispensing position, wherein the charging position of the handle corresponds to the filling position of the plunger, and the dispensing position of the handle corresponds to the discharge position of the plunger; (7) a spring arranged to bias the plunger into the filling position, and the handle into the charging position; (8) a first conduit arranged to connect the inlet to the fluid port; (9) a second conduit arranged to connect the fluid port to the outlet; (10) a first one-way valve disposed within the first conduit; and (11) a second one-way valve disposed within the second conduit.

The second longitudinal axis of the reservoir can extend substantially in parallel with the first axis. The conduits, and all of the components of the applicator, can be made of, e.g., polypropylene, polyurethane, acrylic polymer, nylon, TEFLON®, stainless steel, or aluminum. The valves can be duck-bill valves. The volume of viscous liquid dispensed per stroke can be from 0.2 to 1.0 ml. The inner diameter of the outlet can be least 0.010", or about 0.046".

In certain embodiments, the housing can include two substantially symmetrical side plates and a plurality of spacers, wherein the spacers are arranged between and secured to the side plates to adjust the distance between the side plates. In addition, the fluid port can include first and second openings, wherein the first conduit is arranged to connect the inlet to the first opening, and the second conduit is arranged to connect the second opening to the outlet.

The handle can include a free end and an upwardly extending tab, wherein the tab is pivotally connected to the housing and arranged to contact the plunger and rotate between the charging position and the dispensing position in a direction substantially in parallel with the second longitudinal axis of the reservoir, and wherein the free end rotates between the charging position and the dispensing position in a direction substantially perpendicular to the second longitudinal axis of the reservoir.

The applicator can further include a volume adjustor secured to the housing. The volume adjustor can include a contact portion arranged to contact the handle and to prevent movement of the handle beyond the contact portion, and a movement controller arranged to continuously adjust the position of the contact portion.

The applicator outlet can include a tip at the distal end thereof, e.g., with a round head. In addition, the tip can be arranged to swivel between the angles of 75° to 105° relative to the first longitudinal axis of the housing.

The new viscous liquid applicator is easy to use and maintain. For example, a corn-grower can manually operate the applicator with only one hand, thus enabling the user to use the other hand for other job-facilitating tasks, such as bending or moving corn stalks to apply a viscous liquid such as vegetable oil, to the tassels. The applicator can be easily and thoroughly cleaned. The viscous liquid applicator is provided with a volume adjustor with which the user can manually adjust the amount of the liquid dispensed per stroke.

The applicator has an outlet arranged at an angle in the range of about 75° to 105°, for example, at about 90°, relative to its main body. This outlet may be designed to provide an adjustable angle within this range. The angled outlet delivers the viscous liquid, for example, oil, vertically downward into the corn silk. Accordingly, the user can easily apply the liquid to ears of corn at all levels on the stalk, whether at knee, waist, or chest level. With the new applicator, viscous liquids such as vegetable or mineral oils can be applied in a cost-effective and time-efficient manner. The applicator can also be used to dispense accurate volumes of other viscous liquids having a viscosity similar to that of the oils used to treat sweet corn.

A specially designed tip can also be provided at the end of the angled outlet to protect the corn. The tip has a central hole through which the stream of the viscous liquid is dispensed when the handle is squeezed. By maintaining a proper dimension of this central hole, hydraulic resistance can be minimized. Accordingly, the user can dispense any viscous liquids by applying a minimal pressure, which facilitates ease and comfort of use. The user can also dispense viscous liquids including dissolved or suspended particles, e.g., of a toxin, for example, a microbial insecticide such as *Bacillus thuringienis* (Bt), which kills corn earworm larvae when they ingest the Bt-treated silk on ear tips.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION

The new applicator delivers a defined, adjustable quantity of a viscous liquid, such as vegetable oil or mineral oil, in a short stream that can be accurately and easily applied to ears of corn on corn stalks.

Figure 1:
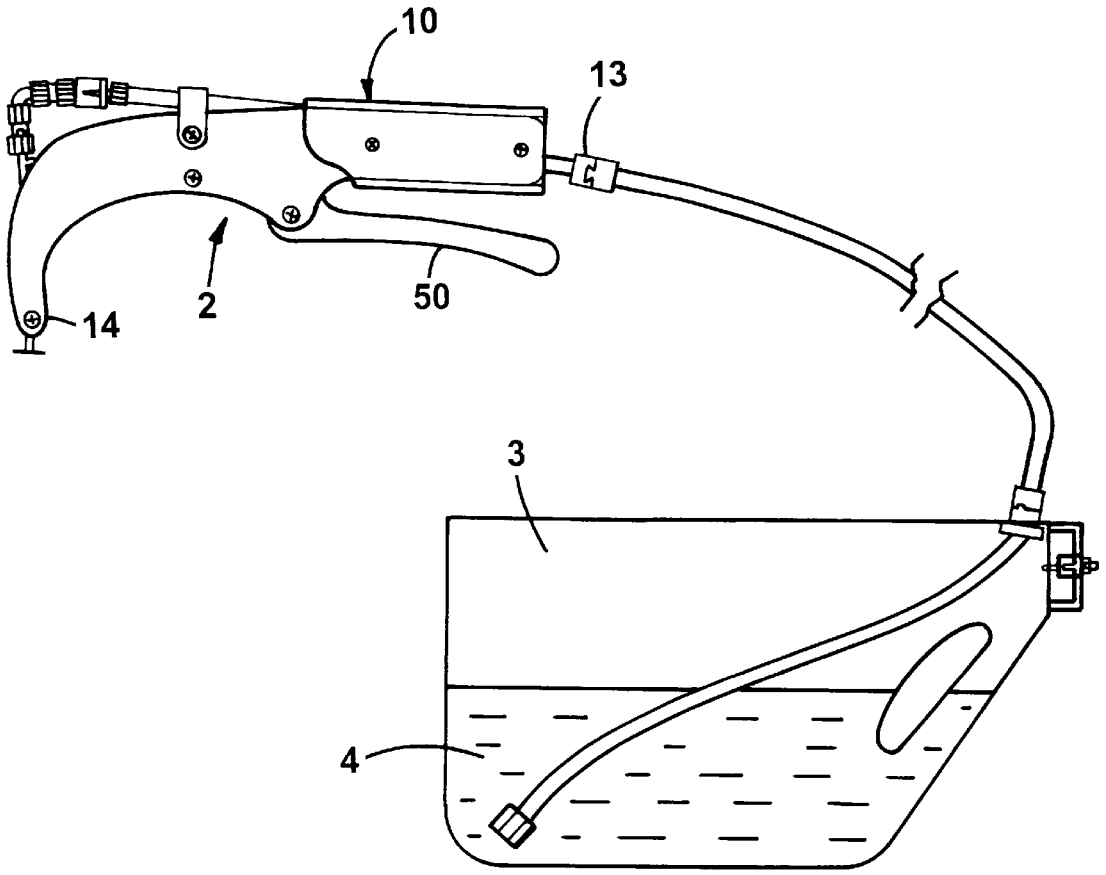
FIG. 1 is a perspective view of the new viscous liquid applicator connected to a portable and refillable tank containing viscous liquid.
Figure 2:
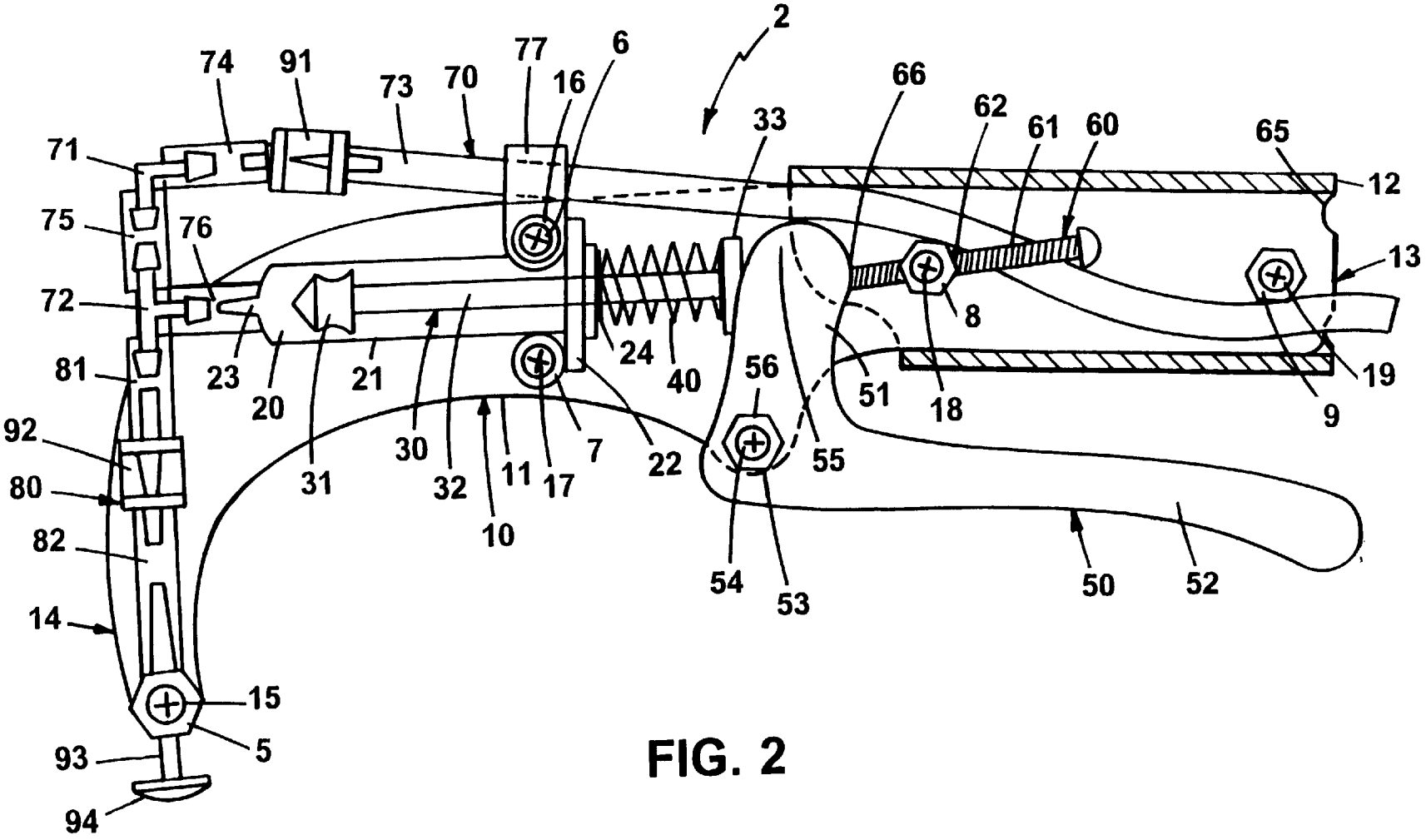
FIG. 2 is an enlarged cross-sectional view of the applicator.

As shown in FIG. 1, a viscous liquid applicator 2 is connected to a tank 3, which is filled with a viscous liquid 4, for example, vegetable or mineral oil. The tank can contain from one-half to one or more gallons, and can be refillable. The applicator 2 generally includes a housing 10, an inlet 13, an outlet 14, a handle 50, and, as shown in FIG. 2, a reservoir 20, a plunger 30, a spring 40, a volume adjustor 60, conduits 70 and 80, and one-way valves 91 and 92. The applicator can be hand-held or mounted on a tractor or other vehicle. Both the applicator and the tank can be portable. For example, the tank can be attached to a waist belt or carried on or in a backpack, depending on the size and weight of the tank. Alternatively, the tank can be much larger and transported on a tractor.

All materials used to manufacture the applicator, and particularly the parts in direct contact with the viscous liquid, are selected such that the parts in contact with the viscous liquid do not contaminate the liquid and are not degraded by the liquid. For example, in an applicator used to deliver vegetable oil, parts should be constructed, e.g., of polypropylene, polyurethane, acrylic polymer, nylon, TEFLON®, stainless steel, or aluminum. Materials such as rubber, neoprene, and PVC cannot be used, because the oil quickly degrades them.

As shown in FIG. 2, a viscous liquid applicator 2 generally includes a housing 10, an inlet 13, an outlet 14, a reservoir 20 (which can be cylindrical, for example, with a circular, rectangular or other shaped cross-section), a plunger 30, a spring 40, a handle 50, a volume adjustor 60, a first conduit 70, a second conduit 80, a first valve 91, and a second valve 92.

The housing 10 includes a main housing 11 and a grip 12. The proximal portion of main housing 11 and grip 12 share a common first longitudinal axis which coincides with their center lines. Housing 10 may be stamped or otherwise worked to a generally hollow configuration to receive the remaining parts of applicator 2. The main housing 11 may also include, for example, two symmetric side plates, wherein spacers 5, 6, 7, 8, 9, and 56 are disposed between the side plates and separate the side plates by the distance equal to the height of each spacer. The spacers are aligned and secured by screws 15, 16, 17, 18, and 19. Main housing 11 is formed of sheet metal of suitable gauge or strength, for example, an aluminum sheet with a thickness of 0.032". The spacers can be made out of any plastic or metal with adequate strength, for example, aluminum spacers with a height of 11/16", 10–32 thread, and an outer diameter of 5/16". The proximal portion of main housing 11 is enclosed by grip 12 which is made, e.g., of a soft and non-slip plastic. For example, the distal part of the main housing 11 can be inserted into a heat-shrinking plastic tubing having a 1.5" inner diameter and the tubing heated to shrink around the housing for a tight fit. Grip 12 may also be secured to main housing 11 by screws 18 and 19.

An inlet 13 is arranged at the proximal end of housing 10 to accommodate the proximal end of the first conduit 70 as it enters housing 10. An outlet 14 is arranged at the distal end of housing 10 and dispenses the viscous liquid out of applicator 2.

Reservoir 20 is arranged within housing 10 and includes a cylinder 21, a concentric collar 22, a fluid opening 23, and a plunger opening 24. The concentric collar 22 is arranged at the proximal end of cylinder 21 and shares with reservoir 20 a common second longitudinal axis which is substantially parallel to the first longitudinal axis. Cylinder 21 is arranged to be received within housing 10 and firmly secured therein by screws 16, 17. Cylinder 21 terminates distally in a fluid opening 23 and proximally in a plunger opening 24. Reservoir 20 is formed, for example, of a resilient plastic or metal which is inert to the particular viscous liquid to be dispensed. The capacity of reservoir 20 may be adjusted by varying the length and the internal diameter of cylinder 21. For example, in applying vegetable oil to an ear of corn, the reservoir can be made of polypropylene and can have a maximum discharge volume of 5 ml per stroke to accommodate the normal dosage of the oil ranging from 0.2 to 1.0 ml per ear.

A cylindrical plunger 30 is arranged to axially slide within reservoir 20 and includes a slider or piston 31, a shaft 32, and a shaft end 33. Shaft 32 is attached to the proximal end of piston 31 such that plunger 30, piston 31, and shaft 32 all share a common longitudinal axis which runs parallel to the second longitudinal axis of the reservoir 20. Shaft end 33 is attached to the proximal end of shaft 32. Shaft end 33 preferably has a larger cross-sectional area than that of shaft 32. Piston 31 is configured to form a circumferential liquid-tight seal against the inner wall of cylinder 21 to prevent the viscous liquid from passing between the piston 31 and the cylinder wall. Piston 31 is made of a material which is inert to a specific viscous liquid to be dispensed, for example, polypropylene. Although shaft 32 and shaft end 33 may not be in direct contact with the viscous liquid, they may also be made of such inert material because they will eventually be exposed to the viscous liquid.

A spring 40 made of, for example, stainless steel, is located between the proximal face of concentric collar 22 and the distal face of shaft end 33. Spring 40 is placed around the proximal portion of plunger shaft 32 and biases the entire plunger 30 axially and proximally. The most proximal position of plunger 30 defines the filling position, whereas the most distal position defines the discharge position. By compressing spring 40 (by applying pressure to handle 50 as described below), plunger 30 moves axially and distally toward the discharge position, and displaces the viscous liquid out of reservoir 20 through fluid opening 23. By releasing spring 40, plunger 30 moves axially and proximally toward the filling position, and draws the viscous liquid into reservoir 20 through fluid opening 23. The discharge volume per stroke is thus determined by the product of the internal cross-sectional area of cylinder 21 and the axial distance of travel of plunger 30 between the filling position and the discharge position.

A handle 50 includes an upwardly extending tab 51 and a free end 52. Tab 51 is drilled or otherwise machined to provide a hole 53 to receive a bolt 54. Handle 50 is attached to housing 10 by bolt 54. The distal portion 55 of tab 51 is configured to be in direct mechanical contact with plunger end 33. Accordingly, free end 52 of handle 50 is biased downwardly by spring 40, defining a charging position. By squeezing free end 52 of handle 50 upwardly toward housing 10, free end 52 rotates around bolt 54 in a direction substantially perpendicular to the second longitudinal axis of reservoir 20 until free end 52 reaches the dispensing position. Because upwardly extending tab 51 is configured to be substantially perpendicular to free end 52, the upward movement of free end 52 is thus transformed into a substantially axial movement of tab 51. Thus, the vertical distance of travel between the charging position and the dispensing position determines the axial distance of travel between the filling position and the discharge position. Handle 50 is fabricated, for example, of bent or formed sheet metal, for example, aluminum, or of molded plastic, as a unitary body.

Still referring to FIG. 2, the viscous liquid applicator 2 is provided with a volume adjustor 60, which can be used to manipulate the discharge volume per stroke of plunger 30. Volume adjustor 60 is arranged within the proximal portion of main housing 11 and includes an adjustment screw 61 and a threaded spacer 8. Spacer 8 has a threaded bore 62 and is secured to main housing 11 by screw 18. Adjustment screw 61 and bore 62 can be configured to share a common longitudinal axis which runs substantially parallel to the second longitudinal axis. Adjustment screw 61 can be rotated by inserting a screw driver through the access hole 65 provided at the end of the proximal part of housing 10.

One example of the viscous liquid applicator 2, as illustrated in FIG. 2, is configured such that the discharge position of plunger 30 and the dispensing position of handle 50 are fixed, whereas the filling position of plunger 30 and the charging position of handle 50 are adjusted by volume adjustor 60. This is accomplished by adjusting the axial location of the contact portion 66 of handle 50 that butts against adjustment screw 61. By preventing further axial and proximal movement of tab 51, the filling position of plunger 30 is defined, determining the distance of travel between the filling position and the discharge position and, therefore, the discharge volume per stroke.

A first conduit 70 is arranged, at least partially, within housing 10, and connects inlet 13 to fluid opening 23. First conduit 70 may include a plurality of tubing segments and joints or can be made of one part, with a valve arranged therein. An embodiment of first conduit 70 illustrated in FIG. 2 includes an elbow joint 71, a T-joint 72, and tubing segments 73, 74, 75, and 76. A one-way valve 91 is disposed between tubing segments 73 and 74 and serves to prevent backward flow of the viscous liquid. A clamp 77 is also disposed to hold tubing 73 in place as well as to protect tubing 73 from damage. Because joints 71, 72 and the tubing segments 73, 74, 75, and 76 are in direct contact with the viscous liquid, they can be made of, e.g., nylon and polyurethane, when the viscous liquid is an oil. Joints 71, 72 may have barbed ends to allow the tubing to be pushed on during assembly but will not allow the tubing to be pulled or blown off during use.

A second conduit 80 is also arranged, at least partially, within housing 10, and connects fluid opening 23 to outlet 14. Second conduit 80 can also include a plurality of tubing segments and barbed joints made of, for example, nylon and polyurethane. A second one-way valve 92 is disposed between the tubing segments 81 and 82, and serves to prevent backward flow of the viscous liquid.

One-way valves 91 and 92 enable the cyclic suction and dispensing of the viscous liquid. For example, when handle 10 is squeezed, upwardly extending tab 51 pushes plunger 30 axially and distally towards the discharge position and displaces the viscous liquid out of cylinder 21 through fluid opening 23. First one-way valve 91 closes, and second one-way valve 92 opens and directs the liquid toward outlet 14. When handle 10 is released, spring 40 expands and pushes plunger 30 back to the filling position. The negative pressure built up in plunger 30 closes second one-way valve 92 and opens first one-way valve 91, thus allowing a specific, controlled volume of the viscous liquid to enter reservoir 20.

Examples of one-way valves 91, 92 include a duckbill type made of acrylic polymer, which minimizes the blockage and backflow.

Second conduit 80 is configured to have an outlet 14 arranged at an angle of between about 75° and 105° relative to the first longitudinal axis of housing 10. For example, second conduit 80 illustrated in FIG. 2 has an outlet 14 arranged perpendicular to the first longitudinal axis. The applicator with an angled outlet is advantageous in applying the viscous liquid downwardly into the corn tassel. Specifically, the vegetable oil applicator with an angled outlet 14 enables the user to apply the vegetable oil to the silk of individual corn ears in a cost-effective and time-efficient manner.

Angled outlet 14 is arranged to have a tip 93 at the distal end. Tip 93 is arranged to have a longitudinal liquid passage, through which a stream of the viscous liquid is dispensed. By maintaining a proper dimension of the passage, the viscous liquid can be dispensed with a minimal pressure. For example, an aluminum tip tube with a 0.046" inner diameter allows manual dispensing of most vegetable oils as well as oils mixed with solid pesticide particles. Depending on the viscosity of a specific liquid to be dispensed, however, the liquid passage can have an inner diameter as small as 0.010". The distal end of tip 93 may also be provided with a flat or a swiveling tip with a round head 94 to protect the corn.

The applicator illustrated in FIG. 2 can be assembled as follows. First all tubing segments 73, 74, 75, 76, 81, and 82, joints 71, 72, valves 91, 92, tip 93, and reservoir 20 are connected to form leak-proof seals. Plunger 30 (and spring 40) is then inserted into plunger opening 24 of reservoir 20 and adjustment screw 61 is inserted through threaded bore 62 of spacer 8. The entire assembly is then placed between the side plate halves of the main housing. Next, spacer 56 is aligned with hole 53 in handle 50. Once this handle assembly is slid into place, and the spring-loaded plunger 30 is pressed into place, screws 15, 16, 17, 18, 19, and 54 are inserted to hold the assembly together. The last step is to wrap the proximal portion of housing 10 with grip 12.

Other Embodiments

Other embodiments are also within the scope of the following claims. For example, the housing can be a unitary body constructed by molding various kinds of metals or plastics. The housing can also include two or more parts. The housing can enclose only a portion of the first and the second conduits, or can enclose the entire conduits to protect them from wear and tear.

In addition, the applicator can have two separate fluid openings, in addition to the plunger opening, such that the first conduit connects the inlet to the first fluid opening and the second conduit connects the second fluid opening to the outlet.

The reservoir may have cross-sectional shapes other than a circular one. In addition, the reservoir can be a bellows-type pump rather than cooperating with a plunger. In this embodiment, the handle presses against a surface of the bellows to compress the reservoir to expel the liquid, and the reservoir expands automatically to draw liquid into the reservoir from the tank.

Furthermore, the volume adjustor may be configured to employ other mechanisms. For example, a volume adjustor can include an adjustment rod with a locking mechanism rather than an adjustment screw. The adjustment rod can be slid into a desired position and locked by a push-button that travels along the exterior of the housing. In addition, the adjustor can be arranged to have pre-set stops corresponding to specific volumes. These volumes can be marked onto the housing.

It is to be understood that while the invention has been described in conjunction with the detailed description thereof, the foregoing description is intended to illustrateand not limit the scope of the invention, which is defined by the scope of the appended claims. Other aspects, advantages, and modifications are within the scope of the following claims.

What is claimed is:

1. An applicator for delivering a stream of viscous liquid to a target comprising:

(1) a housing having a first longitudinal axis;

(2) an inlet arranged at a proximal end of the housing;

(3) an outlet arranged at a distal end of the housing at an angle of 75° to 105° relative to the first longitudinal axis of the housing;

(4) a reservoir secured to the housing and comprising a cylinder, a fluid port at a distal end of the cylinder, and a plunger opening at a proximal end of the cylinder, the reservoir having a second longitudinal axis;

(5) a plunger arranged to slide within the reservoir and comprising a piston connected to a shaft, the shaft having a third longitudinal axis, the plunger sliding within the reservoir between a filling position and a discharge position, wherein the piston forms a seal against the cylinder sufficient to prevent the viscous liquid from passing, wherein proximal displacement of the plunger towards the filling position draws the viscous liquid into the reservoir through the fluid port, and wherein distal displacement of the plunger towards the first discharge position displaces the viscous liquid out of the reservoir through the fluid port;

(6) a handle pivotally connected to the housing and arranged in mechanical communication with the plunger, wherein the handle is movable between a charging position and a dispensing position, wherein the charging position of the handle corresponds to the filling position of the plunger, and the dispensing position of the handle corresponds to the discharge position of the plunger;

(7) a spring arranged to bias the plunger into the filling position, and the handle into the charging position;

(8) a first conduit arranged to connect the inlet to the fluid port;

(9) a second conduit arranged to connect the fluid port to the outlet;

(10) a first one-way valve disposed within the first conduit; and

(11) a second one-way valve disposed within the second conduit.

2. An applicator of claim 1, wherein the housing comprises two substantially symmetrical side plates and a plurality of spacers, wherein the spacers are arranged between and secured to the side plates to adjust the distance between the side plates.

3. An applicator of claim 1, wherein the second longitudinal axis of the reservoir extends substantially in parallel with the first axis.

4. An applicator of claim 1, wherein the fluid port is connected to a T-joint which is connected to the first conduit and the second conduit.

5. An applicator of claim 1, wherein the handle comprises a free end and an upwardly extending tab, wherein the tab is pivotally connected to the housing and arranged to contact the plunger and rotate between the charging position and the dispensing position in a direction substantially in parallel with the second longitudinal axis of the reservoir, and wherein the free end rotates between the charging position and the dispensing position in a direction substantially perpendicular to the second longitudinal axis of the reservoir.

6. An applicator of claim 1, wherein the first and second conduits comprise polypropylene, polyurethane, acrylic polymer, nylon, TEFLON®, stainless steel, or aluminum.

7. An applicator of claim 1, wherein all components of the applicator comprise polypropylene, polyurethane, acrylic polymer, nylon, TEFLON®, stainless steel, or aluminum.

8. An applicator of claim 1, further comprising a volume adjustor secured to the housing, the volume adjustor comprising a contact portion arranged to contact the handle and to prevent movement of the handle beyond the contact portion, and a movement controller arranged to continuously adjust the position of the contact portion.

9. An applicator of claim 1, wherein the outlet comprises a tip at the distal end thereof.

10. An applicator of claim 9, wherein the tip comprises a round head.

11. An applicator of claim 9, wherein the tip is arranged to swivel between the angles of 75° to 105° relative to the first longitudinal axis of the housing.

12. An applicator of claim 1, wherein the first and second valves are duck-bill valves.

13. An applicator of claim 1, wherein the volume of viscous liquid dispensed per stroke is from 0.2 to 1.0 ml.

14. An applicator of claim 1, wherein the outlet has an inner diameter of at least 0.010".

15. An applicator of claim 1, wherein the outlet has an inner diameter of 0.046".

16. An applicator of claim 1, wherein the outlet comprises a liquid passage adapted to dispense a stream of the viscous liquid.

* * * * *